US007692611B2

(12) United States Patent
Jo et al.

(10) Patent No.: US 7,692,611 B2
(45) Date of Patent: Apr. 6, 2010

(54) ELECTRO-OPTICAL DEVICE, DRIVING METHOD THEREFOR, AND ELECTRONIC APPARATUS

(75) Inventors: Hiroaki Jo, Suwa (JP); Hiroshi Horiuchi, Matsumoto (JP); Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 894 days.

(21) Appl. No.: 10/916,605

(22) Filed: Aug. 12, 2004

(65) Prior Publication Data

US 2005/0057191 A1 Mar. 17, 2005

(30) Foreign Application Priority Data

Aug. 25, 2003 (JP) ..... 2003-300035
Jun. 29, 2004 (JP) ..... 2004-191355

(51) Int. Cl.
*G09G 3/30* (2006.01)

(52) U.S. Cl. ..... 345/77; 345/82

(58) Field of Classification Search ..... 345/76–83, 345/84; 315/291, 169.2, 169.3
See application file for complete search history.

(56) References Cited

U.S. PATENT DOCUMENTS 6,404,139 B1 6/2002 Sasaki et al.
6,788,003 B2 9/2004 Inukai et al.
7,046,240 B2 * 5/2006 Kimura ..... 345/212
7,106,350 B2 * 9/2006 Baba et al. ..... 345/691
7,227,517 B2 * 6/2007 Imamura ..... 345/76
2002/0125831 A1 * 9/2002 Inukai et al. ..... 315/169.3
2002/0135312 A1 * 9/2002 Koyama ..... 315/169.3
2003/0057895 A1 * 3/2003 Kimura ..... 315/370
2003/0063078 A1 4/2003 Hanari et al.
2003/0132523 A1 * 7/2003 Ohtani et al. ..... 257/758
2003/0203523 A1 * 10/2003 Yamazaki et al. ..... 438/22
2003/0214493 A1 * 11/2003 Akimoto et al. ..... 345/204
2005/0264492 A1 * 12/2005 Knapp et al. ..... 345/76

FOREIGN PATENT DOCUMENTS

JP A 2001-022323 1/2001
JP 2002-132218 5/2002
JP A 2002-229513 8/2002
JP A-2002-304155 10/2002
JP A 2003-195816 7/2003

* cited by examiner

*Primary Examiner*—Chanh Nguyen
*Assistant Examiner*—Pegeman Karimi
(74) *Attorney, Agent, or Firm*—Oliff & Berridge, PLC

(57) ABSTRACT

To provide an electro-optical device, a driving method therefor, and an electronic apparatus which can accurately control the brightness of electro-optical elements in accordance with the signal level of a data signal. A brightness detection circuit 15 is provided which samples power-supply current Io every time one scan line is selected and which converts the power-supply current Io into a digital voltage signal DS having a digital value corresponding to the power-supply current Io. A light-emission-period control circuit 16 generates light-emission-period control signals H1 to Hn in accordance with a light-emission-period adjusting signal F corresponding to the digital voltage signal DS and outputs the light-emission-period control signals H1 to Hn to corresponding control-signal supply lines G1 to Gn. Further, light-emission-period control transistors of the pixels 20 which are connected to the corresponding control-signal supply lines G1 to Gn are on/off controlled, thereby controlling the light-emission period of the electro-optical elements.

15 Claims, 8 Drawing Sheets

ELECTRO-OPTICAL DEVICE, DRIVING METHOD THEREFOR, AND ELECTRONIC APPARATUS

BACKGROUND OF THE INVENTION

1. Field of Invention

The present invention relates to an electro-optical device, a driving method therefor, and an electronic apparatus.

2. Description of Related Art

In recent years, attention has been given to displays that have electro-optical elements, such as liquid-crystal elements, organic EL elements, electrophoresis elements, and electron emission elements, to serve as electro-optical devices.

One example of an active-matrix-drive system display is an organic EL display that uses organic EL elements as electro-optical elements. With an organic EL display, since the organic EL elements thereof serve as current drive elements, the total amount of light emitted by the display, i.e., the total brightness of the organic EL elements, is proportional to a power-supply current supplied to the pixels. Thus, controlling the level of the power-supply current allows the total amount of light emitted by the display to be controlled.

For example, an organic EL display that has a brightness limiting circuit for limiting the current level of the power-supply current supplied at the cathodes of the organic EL elements is known. FIG. 8 is an electrical block diagram of the known organic EL display. In an organic EL display 80 shown in FIG. 8, a brightness limiting circuit 81 is connected to the cathodes of organic EL elements 83 provided in pixels 82. The brightness limiting circuit 81 is configured with a resistance element Rg.

For example, when a data-line drive circuit 84 supplies a data signal VD having a large signal level to the corresponding pixels 82, a potential drop at the resistance element Rg becomes large by an amount corresponding to the signal level. A voltage between the drain and the source of a drive transistor Td of each pixel 82 decreases, as the potential drop at the resistance element Rg becomes large. Thus, the current level of power-supply current Io is limited correspondingly. The power-supply current Io is proportional to drive current supplied to the organic EL elements 83. Thus, when the power-supply current Io is limited, the current level of drive current Iel decreases correspondingly. As a result, the brightness of the organic EL elements 83 decreases.

When a data-line drive circuit 84 supplies a data signal VD having a small signal level to the organic EL elements 83, a potential drop at the resistance element Rg becomes small by an amount corresponding to the signal level. Thus, the power-supply current Io is output without limitation in accordance with a power-supply voltage VOEL. As a result, the voltage between the drain and the source of the drive transistor Td of each pixel 82 increases, so that the brightness of the organic EL element 83 increases (Patent Document 1).

[Patent Document 1] Japanese Unexamined Patent Application Publication No. 2002-132218

SUMMARY OF THE INVENTION

In the invention disclosed in Patent Document 1, however, the brightness limiting circuit 81 is configured with a resistance element Rg. The resistance element Rg has a linear characteristic. Further, the resistance element Rg is adapted to limit the current level of the power-supply current Io, and thus the voltage-current characteristics of the drive transistors Td vary. As a result, it is difficult to accurately control the brightness of the organic EL elements 83 in accordance with the signal levels of the data signal VD.

In the invention disclosed in Patent Document 1, a voltage between the drain and the source of each drive transistor Td is controlled in accordance with the current level of the power-supply current Io, which is an analog value. As a result, for example, in a full-color displayable organic EL display having pixels for red, green, and blue which are driven by respective different power-supply voltages, voltages between the drains and the sources of the drive transistors Td are controlled simultaneously regardless of the color. Thus, there is a problem in that the color balance varies.

Further, in the organic EL display 80, in order to dynamically control the brightness, the resistance of the resistance element Rg must be large to some degree. Thus, the power consumption increases.

The present invention has been made to overcome the above-described problems, and an object of the present invention is to provide an electro-optical device, a driving method therefor, and an electronic apparatus which can accurately control the brightness of electro-optical elements in accordance with the signal level of a data signal.

[Means for Solving the Problems]

An electro-optical device according to the present invnetion includes a plurality of scan lines, a plurality of signal lines, and pixels arranged at positions corresponding to the respective intersections of the scan lines and the signal lines. A power-supply voltage is supplied to the pixels, and the pixels include active elements, which are driven in accordance with the signal level of an analog signal supplied to the signal lines, and electro-optical elements, which emit light in accordance with the current level of drive current controlled by the active elements. The electro-optical device includes a brightness detection circuit for converting current corresponding to the power-supply voltage into a digital value and for sampling the digital value.

Such an arrangement allows current corresponding to the power-supply voltage to be sampled and converted into a digital value and allows a change in the brightness of the electro-optical elements to be detected in accordance with the digital value. Further, even when the active elements have a non-linear characteristic, controlling a supply period of the drive current flowing through the pixels in accordance with the digital value makes it possible to accurately control characteristics of the active elements in accordance with the digital value without a variation in the characteristics of the active elements. Thus, this arrangement can provide an electro-optical device that can accurately control the brightness of the electro-optical elements.

An electro-optical device according to the present invention includes a plurality of scan lines, a plurality of signal lines, and pixels arranged at positions corresponding to the respective intersections of the scan lines and the signal lines. A power-supply voltage is supplied to the pixels, and the pixels include active elements, which are driven in accordance with the signal level of an analog signal supplied to the signal lines, and electro-optical elements, which emit light in accordance with the current level of drive current controlled by the active elements. The electro-optical device includes a control circuit for controlling the light-emission period of the electro-optical elements in accordance with a change in the brightness of the electro-optical elements.

In this arrangement, the supply period of the drive current flowing through the pixels is controlled in accordance with a change in the brightness of the electro-optical elements. Thus, when the brightness of the electro-optical elements changes, the light-emission period of the electro-optical elements can be controlled immediately in response to the change.

In the electro-optical device, the brightness detection circuit may convert current corresponding to the power-supply voltage into a digital value and sample the digital value, and the brightness detection circuit may control the peak brightness of the electro-optical elements in accordance with the sampled value, and the sampling may be performed every time one of the scan lines is selected.

With this arrangement, when the electro-optical device is configured so as to sample the digital value every time one scan line is selected, it is possible to control the brightness immediately in response to a variation in the power-supply voltage.

In the electro-optical device, the brightness detection circuit may convert current corresponding to the power-supply voltage into a digital value and sample the digital value, and the brightness detection circuit may control the peak brightness of the electro-optical elements in accordance with the sampled value, and the sampling may be performed after two or more of the scan lines are selected.

In this arrangement, after a plurality of scan lines are selected, the brightness of the electro-optical elements corresponding to the selected scan lines is controlled, rather than sampling every time one scan line is selected. Thus, the number of samplings is reduced compared to a case in which sampling is performed every time one scan line is selected, so that the load of the control circuit can be reduced correspondingly.

In the electro-optical device, the pixels may be constituted by switching elements for electrically connecting or disconnecting the active elements and the electro-optical elements, and the switching elements may perform the electrical connection or disconnection in accordance with the digital value.

In this arrangement, controlling the switching elements to be turned on or off in accordance with the digital value makes it possible to accurately control the integrated brightness of the electro-optical elements.

In the electro-optical device, the brightness detection circuit may include an analog-to-digital converter circuit and a voltage amplifier circuit.

This arrangement can reduce loss at the voltage-current converting means that converts the power-supply voltage into current corresponding thereto. Correspondingly, the power consumption can be reduced. This arrangement can provide an electro-optical device that includes the brightness detection circuit having small power consumption.

In the electro-optical device, when the digital value is greater than or equal to a predetermined value or less than or equal to a predetermined value, the control circuit may control the peak brightness of the electro-optical elements in accordance with the digital value.

In this arrangement, for example, every time one scan line is selected, sampling is not performed. Thus, it is possible to reduce the load of the control circuit.

In the electro-optical device, the brightness detection circuit may be provided at anode sides or cathode sides of the electro-optical elements.

In this arrangement, the brightness detection circuit may be provided at the anode sides or cathode sides of the electro-optical elements. Thus, it is possible to increase the freedom of layout of the electro-optical device.

In the electro-optical device, the electro-optical elements may be constituted by electro-optical elements that emit red light, electro-optical elements that emit green light, and electro-optical elements that emit blue light. The control circuit may control the light-emission period of the electro-optical elements that emit red light, the light-emission period of the electro-optical elements that emit green light, and the light-emission period of the electro-optical elements that emit blue light at the same rate to control the peak brightness.

According to this arrangement, for example, when the electro-optical elements that emit red light, the electro-optical elements that emit green light, and the electro-optical elements that emit blue light are arranged along the control lines that are connected to the control circuit and that control the light-emission period, the light-emission brightness of the electro-optical elements for each color which are arranged along the corresponding control line is simultaneously controlled. Thus, in this case, controlling the light emission period so that the balance of red, green, and blue of the electro-optical elements does not vary makes it possible to control the brightness of the electro-optical elements for each color without preparing a control circuit for each color.

In the electro-optical device, the electro-optical elements may be constituted by electro-optical elements that emit red light, electro-optical elements that emit green light, and electro-optical elements that emit blue light. The brightness detection circuit may convert current corresponding to the power supply voltage for the electro-optical elements for each color into a digital value and sample the digital value. The control circuit may determine brightness for a case in which white is displayed, based on the sampled current corresponding to the power-supply voltage for the electro-optical elements for each color, and may control the light-emission period of the electro-optical elements in accordance with a result of the determination to thereby control the peak brightness.

With this arrangement, currents corresponding to the respective power-supply voltages for electro-optical elements that emit red light, electro-optical elements that emit green light, and electro-optical elements that emit blue light are converted into currents corresponding to power-supply voltages of the electro-optical elements that white light, and in accordance with the converted result, the light emission period of the electro-optical elements for each color is controlled. Such an arrangement can control the light emission periods of the electro-optical elements without a variation in the balance (color balance) of red, green, and blue.

In the electro-optical device, the display panel section where the pixels are arranged may be divided into a plurality of sections. The brightness detection circuit may convert current corresponding to the power-supply voltage supplied to the electro-optical elements of each divided display panel section into a digital value and sample the digital value. The control circuit may control the peak brightness of the electro-optical elements of each divided display panel section.

With this arrangement, for each divided display panel section, current corresponding to the power-supply voltage supplied to the electro-optical elements of the display panel section is converted into a digital value and is sampled, and in accordance with the sampled value, the peak brightness of the electro-optical elements is controlled. Thus, for example, in an electro-optical device in which a plurality of display panel sections are laminated to configure one large display panel section, the light-emission period of the electro-optical elements can be controlled for each display panel section.

In the electro-optical device, the electro-optical elements may be constituted by electroluminescent elements having light-emiting layers made of organic material.

This arrangement can accurately control the brightness of the electro-optical device in which the organic EL elements are used as the electro-optical elements.

A driving method for an electro-optical device according to the present invention is provided. The electro-optical device includes a plurality of scan lines, a plurality of signal lines, and pixels arranged at positions corresponding to the respective intersections of the scan lines and the signal lines. The pixels include active elements, which are driven in accordance with the voltage level of a power-supply voltage, and electro-optical elements, which emit light in accordance with the current level of drive current controlled by the active elements. The method includes the steps of converting current corresponding to the power-supply voltage into a digital value and sampling the digital value, and controlling the peak brightness of the electro-optical elements in accordance with the sampled value.

In this arrangement, current corresponding to the power-supply voltage is sampled and is converted into a digital value, and in accordance with the digital value, the current level of the drive current flowing through the pixels is controlled. Thus, for example, even for active elements having a non-linear characteristic, the characteristics of the active elements can be accurately controlled in accordance with the digital value.

A driving method for an electro-optical device according to the present invention is provided. The electro-optical device includes a plurality of scan lines, a plurality of signal lines, and pixels arranged at positions corresponding to the respective intersections of the scan lines and the signal lines. The pixels include active elements, which are driven in accordance with the voltage level of a power-supply voltage, and electro-optical elements, which emit light in accordance with the current level of drive current controlled by the active elements. The method includes the steps of converting current corresponding to the power-supply voltage into a digital value and sampling the digital value, and controlling the illumination period of the electro-optical elements in accordance with the sampled value to adjust the peak brightness.

In this arrangement, the supply period of drive current flowing through the pixels is controlled in accordance with a change in the brightness of the electro-optical elements. Thus, when the brightness of the electro-optical elements changes, the light-emission period of the electro-optical elements can be controlled immediately in response to the change.

In the driving method for the electro-optical device, in the step of converting current corresponding to the power-supply voltage into a digital value and sampling the digital value, the sampling may be performed every time one of the scan lines is selected.

In this arrangement, performing the sampling every time one scan line is selected makes it possible to control the integrated brightness of the electro-optical elements immediately in response to a variation in the power-supply voltage.

In the driving method for the electro-optical device, in the step of converting current corresponding to the power-supply voltage into a digital value and sampling the digital value, the sampling may be performed after two or more of the scan lines are selected.

In this arrangement, after two or more scan lines are selected, the integrated brightness of the electro-optical elements corresponding to the selected scan lines is controlled, rather than sampling every time one scan line is selected. Thus, the number of samplings is reduced compared to a case in which sampling is performed every time one scan line is selected, so that the load of the brightness detection circuit can be reduced correspondingly.

An electronic apparatus according to the present invention includes the electro-optical device described above.

In this arrangement, since the brightness is accurately controlled, it possible to provide an electronic apparatus that has improved display quality.

DETAILED DESCRIPTION OF PREFERRED EMBODIMENTS

Figure 1:
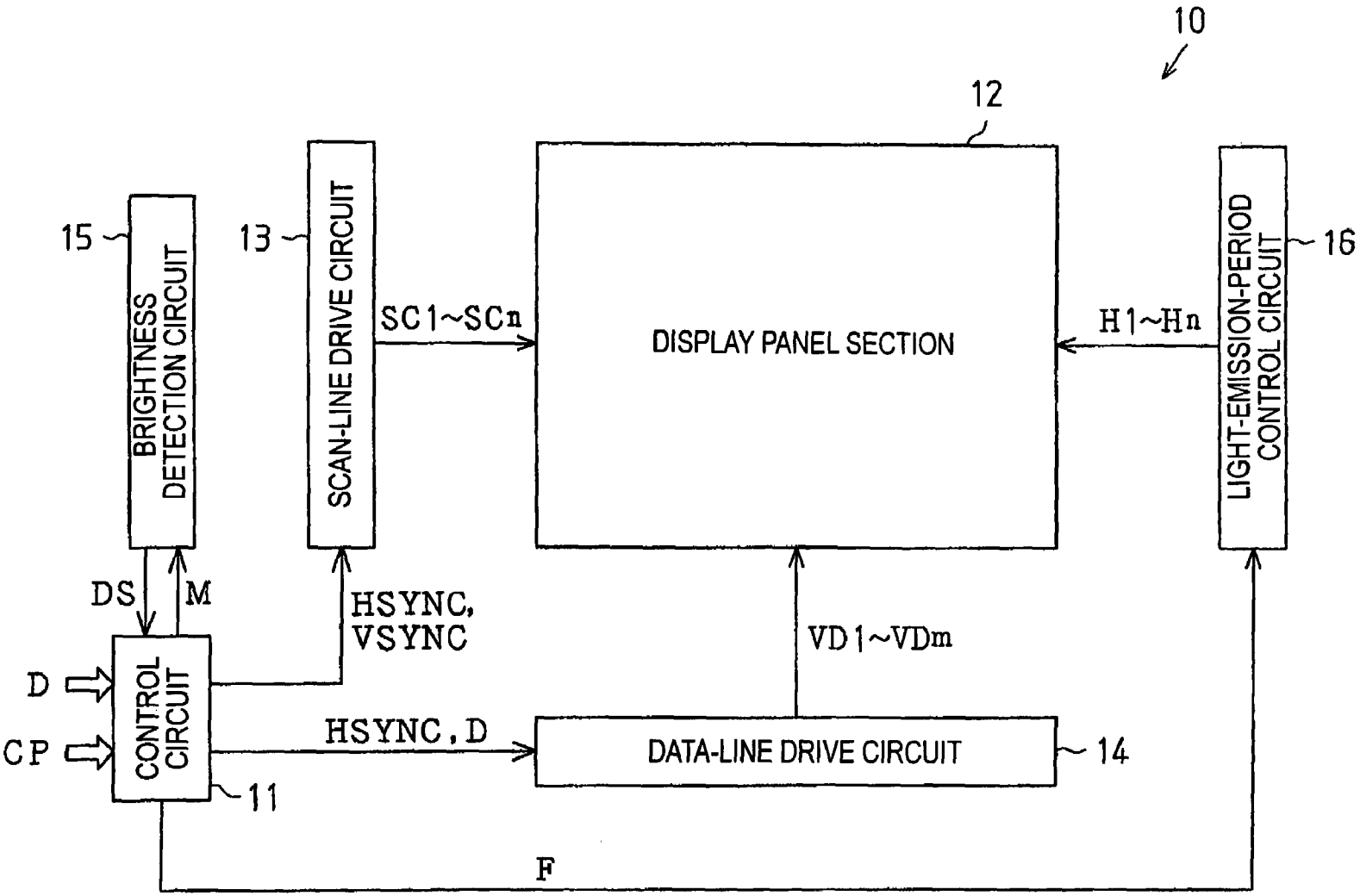
FIG. 1 is a block diagram illustrating the electrical configuration of an organic EL display.

Embodiments of an electroluminescent display according to the present invention will be described below with reference to the accompanying drawings. Each embodiment described below merely represents one aspect of the present invention and is not intended to limit the present invention. Thus, the embodiments described below can be arbitrarily changed within the technical idea of the present invention. Further, in each drawing illustrated below, the scales are made different for individual layers and members to allow them to have such sizes that can be recognized in the drawing.

First Embodiment

Figure 2:
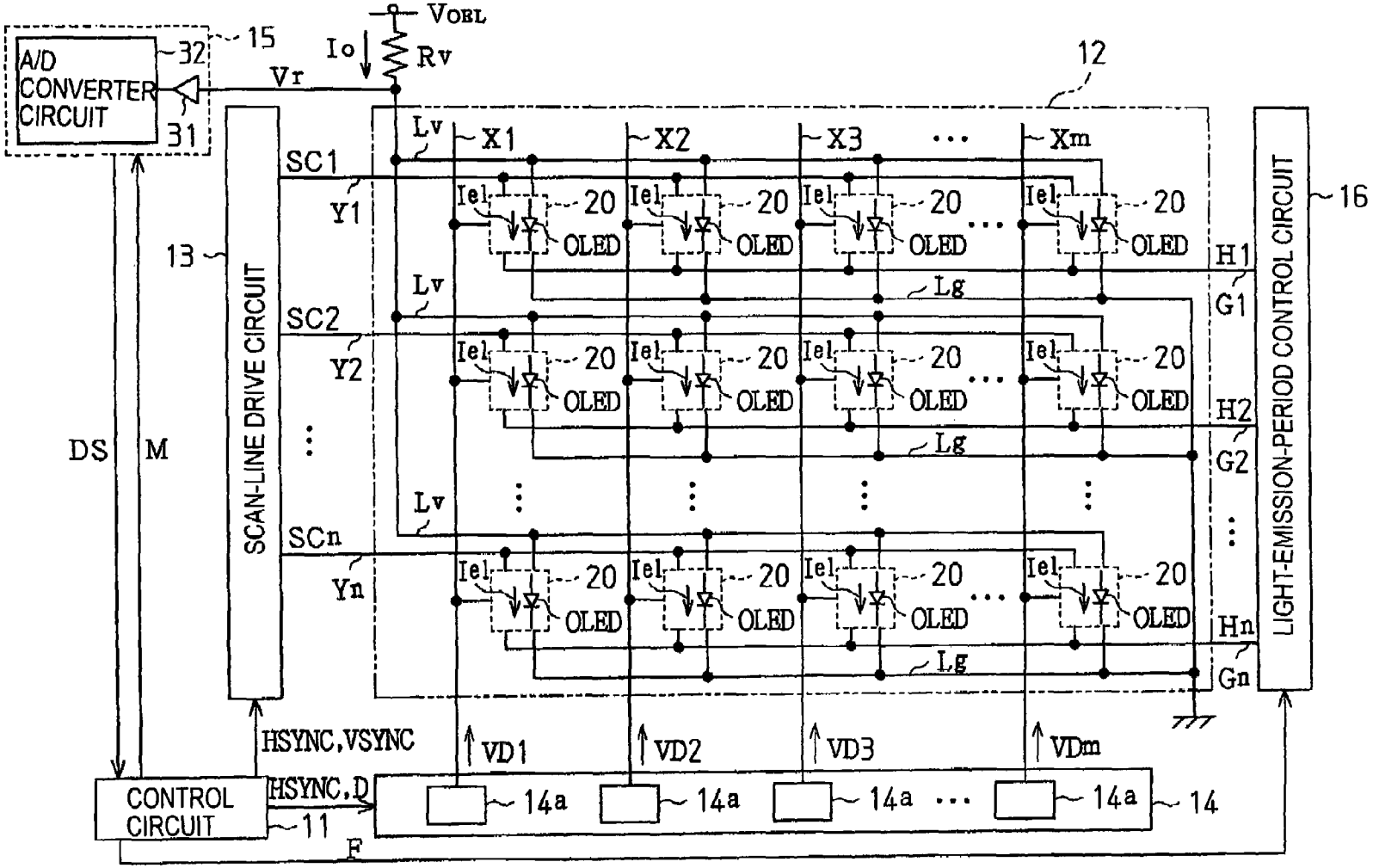
FIG. 2 is a circuit block diagram of the organic EL display of the present invention.

A first embodiment according to the present invention will now be described with reference to FIGS. 1 to 4. FIG. 1 is a block diagram illustrating the electrical configuration of an organic EL display. FIG. 2 is a circuit block diagram of the organic EL display.

As shown in FIG. 1, an organic EL display 10 includes a control circuit 11, a display panel section 12, a scan-line drive circuit 13, a data-line drive circuit 14, a brightness detection circuit 15, and a light-emission-period control circuit 16. The control circuit 11, the scan-line drive circuit 13, the data-line drive circuit 14, the brightness detection circuit 15, and the light-emission-period control circuit 16 in the organic EL display 10 may be constituted by electronic components that are independent from each other. For example, the control circuit 11, the scan-line drive circuit 13, the data-line drive circuit 14, the brightness detection circuit 15, and the light-emission-period control circuit 16 may be constituted by respective one-chip semiconductor integrated circuit devices. Alternatively, some or all of the control circuit 11, the scan-line drive circuit 13, the data-line drive circuit 14, the brightness detection circuit 15, and the light-emission-period control circuit 16 may be constituted by a programmable IC chip or chips, and the functions thereof may be realized through software, i.e., a program, written in the IC chip(s).

The control circuit 11 receives a clock pulse CP and image digital data D. In accordance with the clock pulse CP, the control circuit 11 generates a horizontal synchronization signal HSYNC and a vertical synchronization signal VSYNC for determining timing for displaying an image on the display panel section 12. The control circuit 11 outputs the horizontal synchronization signal HSYNC and the vertical synchronization signal VSYNC to the scan-line drive circuit 13 and also outputs the horizontal synchronization signal HSYNC to the data-line drive circuit 14. Also, upon receiving the image digital data D, the control circuit 11 outputs the received image digital data D to the data-line drive circuit 14.

Further, the control circuit 11 samples power-supply current Io (see FIG. 2) at timing based on the clock pulse CP and generates a current-measurement signal M for determining timing for measuring the level of the power-supply current Io. The control circuit 11 outputs the generated current-measurement signal M to the brightness detection circuit 15 at predetermined timing. In this embodiment, the control circuit 11 is configured to output the current-measurement signal M to the brightness detection circuit 15 every time one scan line is selected.

The control circuit 11 also receives a digital voltage signal DS output from the brightness detection circuit 15. The digital voltage signal DS has a voltage corresponding to the electrical-current level of the power-supply current Io. In accordance with the digital voltage signal DS, the control circuit 11 generates a light-emission-period adjusting signal F for determining the light-emission period of organic EL elements OLED (see FIG. 2) and outputs the generated light-emission-period adjusting signal F to the light-emission-period control circuit 16.

As shown in FIG. 2, the display panel section 12 has n scan lines Y1, Y2, . . . , and Yn (n is a natural number) extending in the row direction. The display panel section 12 also has m data lines X1, X2, . . . , and Xm (m is a natural number) extending in the column direction. Pixels 20 are arranged at positions corresponding to the respective intersections of the scan lines Y1 to Yn and the data lines X1 to Xm.

The pixels 20 are connected to the corresponding data lines X1 to Xm and are electrically connected to the data-line drive circuit 14 via the data lines X1 to Xm. The pixels 20 are also connected to the corresponding scan lines Y1 to Yn and are electrically connected to the scan-line drive circuit 13 via the scan lines Y1 to Yn.

The display panel section 12 has n power-supply lines Lv that extend parallel to the scan lines Y1 to Yn. Each power-supply line Lv is connected to the individual pixels 20 in one corresponding row. Then, power supply lines Lv are connected together and are mutually connected to a measuring resistance element Rv. A power-supply voltage VOEL is supplied to the measuring resistance element Rv. Thus, the power-supply voltage VOEL is supplied to the pixels 20 via the measuring resistance element Rv and the power-supply lines Lv. Thus, the power-supply current Io, which is an analog signal, flows through the measuring resistance element Rv. The power-supply current Io has a level that is equal to the sum total of the current levels of drive current Iel flowing through all the organic EL elements OLED. The organic EL elements OLED are so-called "current drive elements" and have brightness that is proportional to the current level of the drive current Iel. Thus, the current level of the power-supply current Io is proportional to the total amount of light emitted by the organic EL display 10, i.e., the total brightness of the organic EL elements OLED.

The measuring resistance element Rv is a resistance element for converting the current level of the power-supply current Io into a voltage signal. Thus, for example, when the organic EL elements OLED are caused to emit light with their maximum brightness, the current level of the power-supply current Io increases correspondingly. As a result, a potential drop at the measuring resistance element becomes large, so that the voltage level of a voltage signal converted by the measuring resistance element Rv increases. Also, for example, when the organic EL elements OLED do not emit light, the current level of the power-supply voltage Io decreases correspondingly. As a result, the potential drop at the measuring resistance element Rv becomes small, so that a voltage signal converted by the measuring resistance element Rv decreases.

The display panel section 12 further has n common ground lines Lg that extend parallel to the scan lines Y1 to Yn. Each common-ground line Lg is connected to the individual pixels 20 in one corresponding row. The common ground lines Lg are connected together and are connected to ground.

The display panel section 12 further has n control-signal supply lines G1, G2, . . . and Gn that extend parallel to the scan lines Y1 to Yn. Each of the control-signal supply lines G1 to Gn is connected to the individual pixels 20 in one corresponding row. The control-signal supply lines G1 to Gn are also connected to the light-emission-period control circuit 16.

Figure 3:
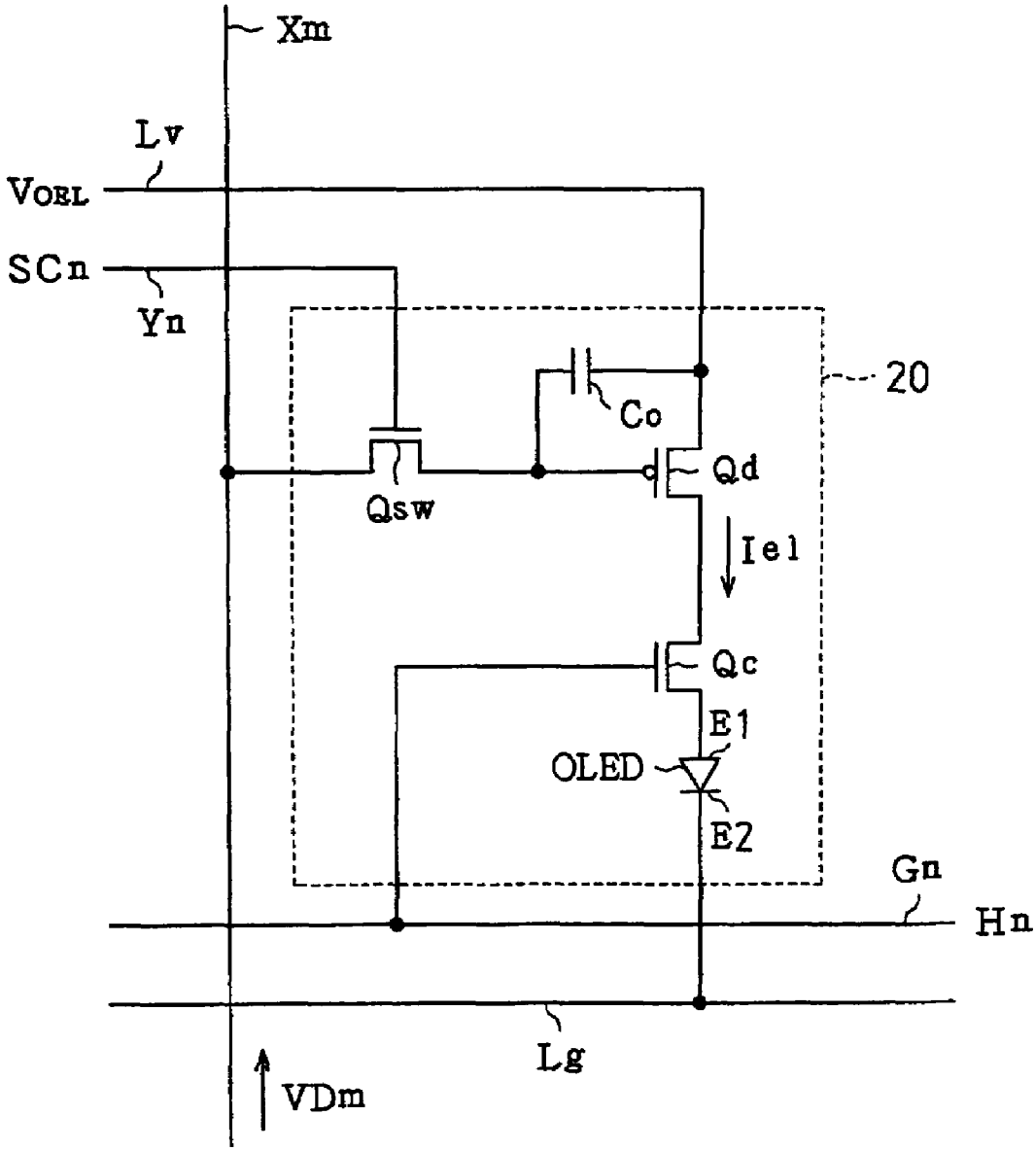
FIG. 3 is a circuit diagram of one pixel.

FIG. 3 is an equivalent circuit diagram of one pixel 20 provided at a position corresponding to the intersection of the nth scan line Yn of the scan lines Y1 to Yn and the mth data line Xm of the data lines X1 to Xm. The electrical configuration of the pixel 20 is the same as the pixels provided at positions corresponding to the other intersections of the scan lines and the data lines. Thus, for ease of illustration, only the pixel provided at a position corresponding to the intersection of the nth scan line Yn and the mth data line Xm will be described below, and the description of the pixels provided at positions corresponding to the other intersections of the scan lines and the data lines is omitted.

Each pixel 20 in this embodiment includes a switching transistor Qsw, a drive transistor Qd, an organic EL element OLED, a storage capacitor Co, and a light-emission-period control transistor Qc.

The switching transistor Qsw has a gate connected to the nth scan line Yn and is on/off controlled in accordance with a scan signal SCn output from the scan-line drive circuit 13. The switching transistor Qsw has n-type conductivity in this embodiment. The switching transistor Qsw is also configured with a TFT (thin-fihn transistor) in this embodiment. When a high-level scan signal SCn is input via the scan line Yn, the switching transistor Qsw is turned on. In response, a data signal VDm that is supplied to the mth data line Xm is supplied to the storage capacitor Co via the switching transistor Qsw. As a result, the storage capacitor Co stores an electrical charge corresponding to the voltage level of the data signal VDm.

The source of the drive transistor Qd is connected to the power-supply line Lv, and the power-supply voltage VOEL is applied between the source and the drain of the drive transistor Qd. The storage capacitor Co is connected between the source and the gate of the drive transistor Qd. Thus, the drive current Iel having a current level corresponding to the electrical charge stored by the storage capacitor Co flows between the source and the drain of the drive transistor Qd.

The organic EL element OLED is an EL (electroluminescent element) having a light emitting layer made of organic material. A cathode E2 of the organic EL element OLED is connected to the common-ground line Lg. The light-emission-period control transistor Qc is provided between an anode E1 of the organic EL element OLED and the drain of the drive transistor Qd.

The gate of the light-emission-period control transistor Qc is connected to the nth control-signal supply line Gn. The light-emission-period control transistor Qc has n-type conductivity in this embodiment. When a high-level light-emission-period control signal Hn is input to the gate of the light-emission-period control transistor Qc, the light-emission-period control transistor Qc is turned on. Thus, the drain of the drive transistor Qd and the anode E1 of the organic EL element OLED are electrically connected. As a result, the drive current Iel flowing between the source and the drain of the drive transistor Qd is supplied to the organic EL element OLED. In response, the organic EL element OLED emits light with brightness corresponding to the current level of the drive current Iel.

When a low-level light-emission-period control signal Hn is input to the gate of the light-emission-period control transistor Qc, the light-emission-period control transistor Qc is turned off, so that the drain of the drive transistor Qd and the anode E1 of the organic EL element OLED are electrically disconnected. As a result, the drive current Iel flowing between the source and the drain of the drive transistor Qd is not supplied to the organic EL element OLED. In this manner, supplying the high-level or low-level light-emission-period control signal Hn to the gate of the light-emission-period control transistor Qc can control the light-emission period of the organic EL element OLED.

Figure 4:
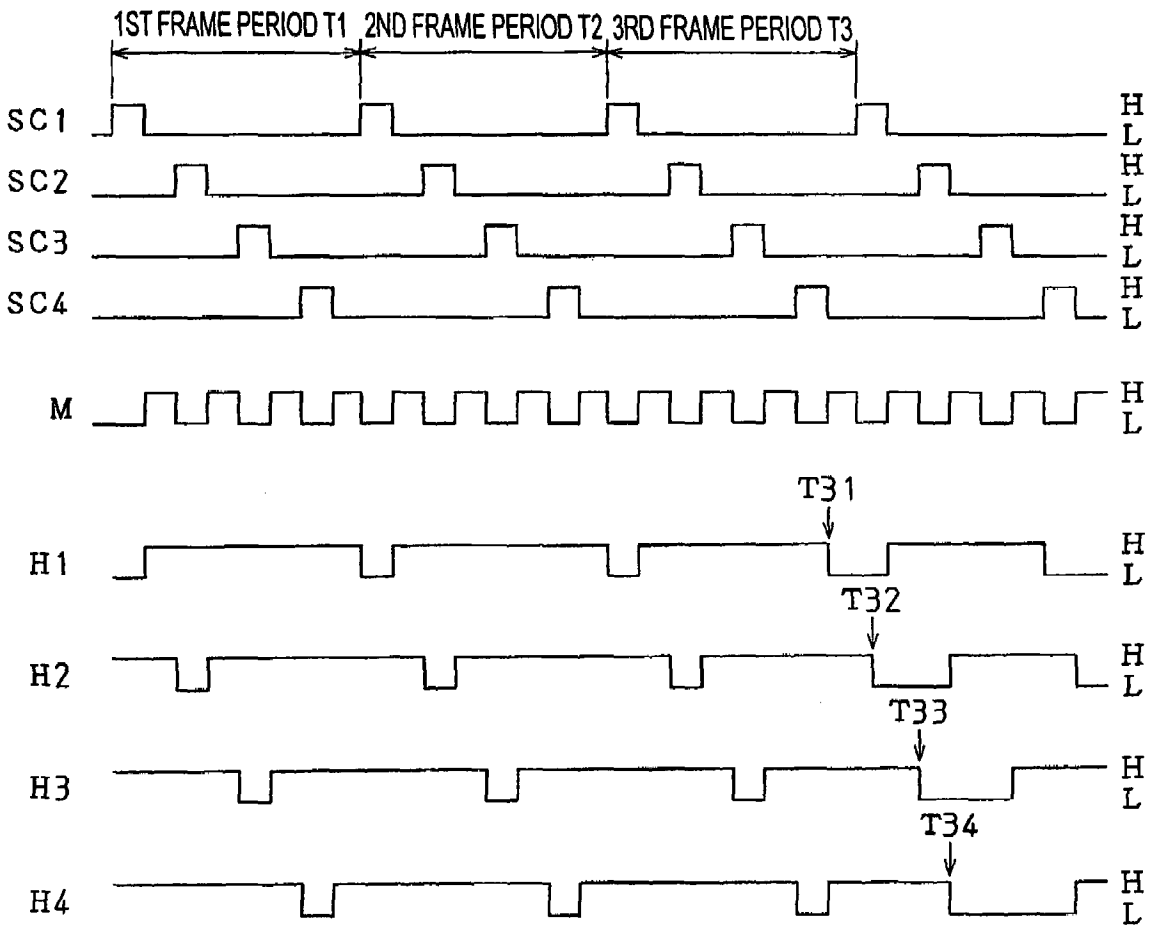
FIG. 4 is a timing chart for illustrating a method for driving the organic EL display.

The scan-line drive circuit 13 generates scan signals SC1, SC2, . . . , and SCn. Each of the scan signals SC1 to SCn is a voltage signal having a logically low level or high level, as shown in FIG. 4. In accordance with the horizontal synchronization signal HSYNC, the scan-line drive circuit 13 outputs a high-level signal to thereby line-sequentially select the scan lines Y1 to Yn in the order of Y1→Y2→Y3→ . . . →Yn→Y1.

The data-line drive circuit 14 includes m single-line drivers 14*a*, as shown in FIG. 2. The individual single-line drivers 14*a* are connected to the pixels 20 in the corresponding columns via the data lines X1 to Xm. The single-line drivers 14*a* convert the image digital data D output from the control circuit 11 into data signals VD1, VD2, . . . , and VDm, which are analog voltage signals. The single-line drivers 14*a* then output the data signals VD1, VD2, . . . , and VDm to the corresponding pixels 20 via the data lines X1 to Xm.

In this embodiment, the brightness detection circuit 15 is provided at the anode E1 (see FIG. 3) sides of the organic EL elements OLED. As shown in FIG. 2, the brightness detection circuit 15 includes an amplifier 31 and an A/D converter circuit 32. The amplifier 31 has an input terminal connected to the cathode of the measuring resistance element Rv. The output terminal of the amplifier 31 is connected to the A/D converter circuit 32. The A/D converter circuit 32 is a so-called "voltage-output type analog-to-digital converter circuit".

The amplifier 31 receives a voltage Vr corresponding to a voltage drop in the power-supply voltage VOEL which is caused by the measuring resistance element Rv. As described above, the voltage Vr is an analog voltage signal having a voltage level corresponding to the power-supply current Io converted by the measuring resistance element Rv.

The amplifier 31 amplifies the voltage Vr to a predetermined amount and supplies the amplified voltage Vr to the A/D converter circuit 32 at the subsequent stage. When the current level of the drive current Iel flowing through all the pixels 20 is large, the voltage level of the voltage Vr increases. When the current level of the drive current Iel flowing through all the pixels 20 is small, the voltage level of the voltage Vr decreases.

The A/D converter circuit 32 converts the voltage Vr into a digital value to thereby generate the digital voltage signal DS. Thus, the digital voltage signal DS is a digital signal having a level corresponding to the voltage level of the voltage Vr.

The brightness detection circuit 15 outputs the digital voltage signal DS to the control circuit 11 at the timing of the current measurement signal M output from the control circuit 11. With this arrangement, the control circuit 11 can recognize the total amount of light emitted by the organic EL display 10, i.e., the total of integrated brightness of the organic EL elements OLED.

The light-emission-period control circuit 16 receives the light-emission-period adjusting signal F output from the control circuit 11. As described above, the light-emission-period adjusting signal F is a signal based on the digital voltage signal DS. The light-emission-period control circuit 16 generates light-emission-period control signals H1, H2, . . . , and Hn in accordance with the light-emission-period adjusting signal F. As shown in FIG. 4, each of the light-emission-period control signals H1 to Hn is a voltage signal having a logically high level or low level. The light-emission-period control circuit 16 then outputs the light-emission-period control signals H1 to Hn to the corresponding control-signal supply lines G1 to Gn.

In more detail, the light-emission-period adjusting signal F is a signal for determining the timing at which the light-emission-period control signals H1 to Hn fall. For example, when the control circuit 11 receives the digital voltage signal DS corresponding to a large current level of the drive current Iel flowing through the organic EL elements OLED of selected pixels 20, the light-emission-period adjusting signal F acts as a signal for causing the light-emission-period control signal H1 to Hn to fall earlier. In accordance with the light-emission-period adjusting signal F, the light-emission-period control circuit 16 generates the light-emission-period control signals H1 to Hn that rise at earlier timing, i.e., that have a small light-emission duty ratio, and outputs the light-emission-period control signals H1 to Hn to the corresponding control-signal supply lines G1 to Gn.

As a result, the light-emission-period control transistors Qc that are connected to the corresponding control-signal supply lines G1 to Gn are on/off controlled by a small light-emission duty ratio corresponding to the light-emission-period control signals H1 to Hn, thereby reducing the light-emission period of the organic EL elements OLED of the selected pixels 20. Correspondingly, the integrated brightness of the organic EL elements OLED of the selected pixels 20 decreases. In this manner, the peak brightness of the organic EL elements OLED is controlled.

When the control circuit 11 receives the digital voltage signal DS corresponding to a small current level of the drive current Iel flowing through the organic EL elements OLED of selected pixels 20, the light-emission-period adjusting signal F acts as a signal for delaying the timing at which the light-emission-period control signal H1 to Hn fall. In accordance with the light-emission-period adjusting signal F, the light-emission-period control circuit 16 generates the light-emission-period control signals H1 to Hn that rise late, i.e., that have a large light-emission duty ratio, and outputs the light-emission-period control signals H1 to Hn to the corresponding control-signal supply lines G1 to Gn. Thus, the period of the high level of the light-emission-period control signals H1 to Hn output from the light-emission-period control circuit 16 corresponds to the sum total of the voltage levels of the data signals VD1 to VDm.

As a result, the light-emission-period control transistors Qc, which are connected to the corresponding control-signal supply lines G1 to Gn, are on/off controlled by a large light-emission duty ratio corresponding to the light-emission-period control signals H1 to Hn, thereby extending the light-emission period of the organic EL elements OLED of the selected pixels 20. Correspondingly, the integrated brightness of the organic EL elements OLED of the selected pixels 20 increases. In this manner, the peak brightness of the organic EL elements OLED is controlled.

As described above, the light-emission-period control circuit 16 can control the light-emission period of the organic EL elements OLED in accordance with the current level of the drive current Iel flowing through the organic EL elements OLED of selected pixels 20.

The organic EL display 10 configured as described above includes the brightness detection circuit 15, which samples the power-supply current Io every time one scan line is selected and converts the power-supply current Io into the digital voltage signal DS having a digital value corresponding to the power-supply current Io. The light-emission-period control circuit 16 generates the light-emission-period control signals H1 to Hn in accordance with the light-emission-period adjusting signal F corresponding to the digital voltage signal DS at each time and outputs the light-emission-period control signals H1 to Hn to the corresponding control-signal supply lines G1 to Gn. Further, the light-emission-period control transistors Qc of the pixels 20 connected to the corresponding control-signal supply lines G1 to Gn are on/off controlled. As a result, it is possible to control the light-emission period of the organic EL elements OLED of the pixels 20.

Thus, for example, when the organic EL display 10 is configured with a full-color-displayable display in which elector-optical elements that emit red light, electro-optical elements that emit green light, and electro-optical elements that emit blue light are arranged along the direction in which the scan lines Y1 to Yn extend, the light-emission brightness of the electro-optical elements that are connected to each corresponding control-signal supply line and that emit one of the red light, green light, and blue light is simultaneously controlled. That is, the light-emission period of the electro-optical elements that emit red light, the light-emission period of the electro-optical elements that emit green light, and the light-emission period of the electro-optical elements that emit blue are controlled at the same rate. For example, the control circuit controls the light-emission period so that the balance (color balance) of the red, green, and blue of the electro-optical elements does not vary. Such an arrangement makes it possible to control the brightness of the electro-optical elements for each color without preparing a control circuit for each color.

Further, in this case, the brightness detection circuit 15 in this embodiment samples the power-supply current Io every time one scan line is selected to generate the digital voltage signal DS, so that the integrated brightness of the organic EL elements OLED can be controlled immediately in response to a change in the power-supply current Io. In addition, since the light-emission period of the organic EL elements OLED is controlled in accordance with the digital voltage signal DS, the voltage-current characteristic of the drive transistors Qd does not change. As a result, it is possible to accurately control the brightness of the organic EL elements OLED in accordance with the signal levels of the data signals VD1 to VDm.

In this embodiment, the amplifier 31 and the A/D converter circuit 32 constitute the brightness detection circuit 15. This arrangement, therefore, can reduce the loss at the measuring resistance element Rv, thereby allowing the power consumption to be reduced correspondingly.

A method for driving the organic EL display 10 configured as described above will now be described with reference to FIG. 4. FIG. 4 is a timing chart for illustrating a method for driving the organic EL display 10 according to this embodiment. An organic EL display having four scan lines Y1 to Y4 will be described, for simplicity of description.

First, the scan-line drive circuit 13 outputs a high-level scan signal SC1 to the first scan line Y1. At this timing, the single-line drivers 14*a* in the data-line drive circuit 14 output the data signals VD1 to VDm. At this point, all the voltage levels of the data signals VD1 to VDm are "0". Thus, the storage capacitors Co of the m pixels 20 connected to the first scan line Y1 do not store electrical charges.

Thereafter, the scan-line drive circuit 13 outputs a low-level scan signal SC1 to the first scan line Y1. As a result, the writing of the data signals VD1 to VDm to the m pixels 20 connected to the first scan line Y1 is completed. Subsequently, the control circuit 11 outputs the current measurement signal M to the brightness detection circuit 15. At this point, as described above, since all the voltage levels of the data signals VD1 to VDm are "0", the current level of the drive current Iel flowing through the organic EL elements OLED of the selected pixels 20 becomes substantially "0".

Thus, the control circuit 11 generates the light-emission-period adjusting signal F for delaying the fall timing of the first light-emission-period control signal H1 and outputs the light-emission period adjusting signal F to the light-emission-period control circuit 16. Consequently, in accordance with the light-emission-period adjusting signal F, the light-emission-period control circuit 16 generates the light-emission-period control signal H1 that rises late, i.e., that has a large light-emission duty ratio, and outputs the light-emission-period control signal H1 to the first control-signal supply line G1. As shown in FIG. 4, the first light-emission-period control signal H1 in this embodiment is a light-emission-period control signal that falls when the pixels 20 connected to the first scan line Y1 are selected again after the end of a first frame. In this manner, the light-emission period of the pixels 20 connected to the first scan line Y1 is determined.

Subsequently, the scan-line drive circuit 13 outputs a high-level scan signal SC2 to the second scan line Y2. At this timing, the single-line drivers 14*a* output the data signals VD1 to VDm. At this point, all the voltage levels of the data signals VD1 to VDm are "0". Thus, the storage capacitors Co of the m pixels 20 connected to the second scan line Y2 do not store electrical charges.

Thereafter, the scan-line drive circuit 13 outputs a low-level scan signal SC2 to the second scan line Y2. As a result, the writing of the data signals VD1 to VDm to the m pixels 20 connected to the second scan line Y2 is completed. Subsequently, the control circuit 11 outputs the current measurement signal M to the brightness detection circuit 15. At this point, as described above, since all the voltage levels of the data signals VD1 to VDm are "0", the current level of the drive current Iel flowing through the organic EL elements OLED of the selected pixels 20 becomes substantially "0".

Thus, the control circuit 11 generates the light-emission-period adjusting signal F for delaying the fall timing of the second light-emission-period control signal H2 and outputs the light-emission period adjusting signal F to the light-emission-period control circuit 16. Consequently, in accordance with the light-emission-period adjusting signal F, the light-emission-period control circuit 16 generates the light-emission-period control signal H2 that rises late, i.e., that has a large light-emission duty ratio, and outputs the light-emission-period control signal H2 to the second control-signal supply line G2. The second light-emission-period control signal H2 is a light-emission-period control signal that falls when the pixels connected to the second scan line Y2 are selected again, as in the first frame period T1. In this manner, the light-emission period of the pixels 20 connected to the second scan line Y2 is determined.

Similarly, high-level scan signals SC3 and SC4 are sequentially output to the third scan line Y3 and the fourth scan line Y4, respectively. Every time each of the third scan line Y3 and the fourth scan line Y4 is selected, the data signals VD1 to VDm whose voltage levels are all "0" are output. In the same manner as described above, the light-emission period of the pixels 20 connected to the third and fourth scan lines Y3 and Y4 is determined. Thus, the integrated brightness of the organic EL elements OLED in the first frame period T1 is controlled.

Thereafter, in the subsequent second frame period T2, high-level scan signals SC1 to SC4 are sequentially output to the first scan line Y1 to the fourth scan line Y4, respectively. Then, every time each of the first scan line Y1 to the fourth scan line Y4 is selected, the data signals VD1 to VDm whose voltage levels are all "0" are output.

Every time after each of the scan lines Y1 to Y4 is selected, the control circuit 11 outputs the current measurement signal M to the brightness detection circuit 15 in the same manner as described above, so that the respective fall timings of the first to fourth light-emission-period control signals H1 to H4 are determined. In the same manner as described above, the ON periods of the light-emission-period control transistors Qc of the pixels 20 connected to the first to fourth scan lines Y1 to Y4 are determined. With this arrangement, the brightness of the organic EL elements OLED is controlled as in the first frame period T1.

Thereafter, in a third frame period T3, the scan-line drive circuit 13 outputs a high-level scan signal SC1 to the first scan line Y1 again. At this timing, the single-line drivers 14*a* output the data signals VD1 to VDm. At this point, all of the data signals VD1 to VDm have a predetermined voltage level other than 0. Thus, the data signals VD1 to VDm are written to the m pixels 20 connected to the first scan line Y1, so that charges corresponding to the voltage levels of the data signals VD1 to VDm are stored by the storage capacitors Co.

Thereafter, the scan-line drive circuit 13 outputs a low-level scan signal SC1 to the first scan line Y1. As a result, the writing of the data signals VD1 to VDm to the m pixels 20 connected to the first scan line Y1 is completed. In response, the drive current Iel having a current level corresponding to the electrical charge stored by the storage capacitors Co flows between the drain and the source of the drive transistors Qd of the m pixels 20 connected to the first scan line Y1.

Subsequently, the control circuit 11 outputs the current measurement signal M to the brightness detection circuit 15. At this point, since the data signals VD1 to VDm are all at the above-noted predetermined voltage level, the current level of the power-supply current Io increases so as to correspond to the voltage level. Thus, the control circuit 11 generates the light-emission-period adjusting signal F indicating falling to the low level at timing earlier than the rise timing for the first and second frames, and outputs the light-emission-period adjusting signal F to the light-emission-period control circuit 16.

Consequently, in accordance with the light-emission-period adjusting signal F, the light-emission-period control circuit 16 generates the light-emission-period control signal H1 that falls earlier, i.e., that has a small light-emission duty ratio, and outputs the light-emission-period control signal H1 to the first control-signal supply lines G1. As shown in FIG. 4, the first light-emission-period control signal H1 is a light-emission-period control signal that falls at timing T31 in a shorter period of time than one frame period. As a result, the integrated brightness of the organic EL elements OLED of the pixels 20 connected to the first scan line Y1 is reduced correspondingly.

Thereafter, the scan-line drive circuit 13 outputs a high-level scan signal SC2 to the second scan line Y2. At this timing, the single-line drivers 14*a* output the data signals VD1 to VDm. The voltage levels of the data signals VD1 to VDm at this point are all at predetermined levels that are other than 0 and that are equal to the voltage levels of the data signals VD1 to VDm supplied to the pixels 20 connected to the first scan line Y1. Thus, the data signals VD1 to VDm are written to the m pixels 20 connected to the second scan line Y2, so that charges corresponding to the voltage levels of the data signals VD1 to VDm are stored by the storage capacitors Co.

Thereafter, the scan-line drive circuit 13 outputs a low-level scan signal SC2 to the second scan line Y2. As a result, the writing of the data signals VD1 to VDm to the m pixels 20 connected to the second scan line Y2 is completed. In response, the drive current Iel having a current level corresponding to electrical currents stored in the storage capacitors Co flows between the drain and the source of the drive transistors Qd of the m pixels 20 connected to the second scan line Y2, so that the organic EL elements OLED emit light.

Subsequently, the control circuit 11 outputs the current measurement signal M to the brightness detection circuit 15. At this point, since the data signals VD1 to VDm are all at the above-noted predetermined voltage level, the current level of the power-supply current Io further increases so as to correspond to the voltage level. The current level of the power supply current Io is obtained by adding the drive current Iel flowing through the organic EL elements OLED of the pixels 20 connected to the second scan line Y2 to the drive current Iel flowing through the organic EL elements OLED of the pixels 20 connected to the first scan line Y1.

Thus, the control circuit 11 generates the light-emission-period adjusting signal F indicating falling in a still shorter period of time than the light-emission-period adjusting signal F that has previously been output, and outputs the generated light-emission-period adjusting signal F to the light-emission-period control circuit 16. In accordance with the light-emission-period adjusting signal F, the light-emission-period control circuit 16 generates the second light-emission-period control signal H2 that falls earlier, i.e., that has a small light-emission duty ratio, and outputs the second light-emission-period control signal H2 to the second control-signal supply line G2. As shown in FIG. 4, the second light-emission-period control signal H2 is a light-emission-period control signal that falls at timing T32 in a still shorter period of time than one frame period. In this manner, the ON period of the light-emission-period control transistors Qc of the pixels 20 connected to the second scan line Y2 is determined. Accordingly, the integrated brightness of the organic EL elements OLED of the pixels 20 connected to the second scan line Y2 becomes even smaller than the integrated brightness of the organic EL elements OLED of the pixels 20 connected to the first scan line Y1.

Similarly, high-level scan signals SC3 and SC4 are sequentially output to the third scan line Y3 in the third frame and the fourth scan line Y4. Every time each of the third scan line Y3 and the fourth scan line Y4 is selected, the data signals VD1 to VDm having a predetermined voltage level other than "0" are output.

Every time after each of the scan lines Y3 and Y4 is selected, the control circuit 11 outputs the current measurement signal M to the brightness detection circuit 15 in the same manner as described above, so that the fall timings of the third and fourth light-emission-period control signals H3 and H4 are determined, respectively.

The third light-emission-period control signal H3 that rises at timing T33 is a light-emission-period control signal that falls to a low level in a still shorter period of time than the second light-emission-period control signal H2 that has previously been output. The fourth light-emission-period control signal H4 that rises at timing T34 is a light-emission-period control signal that falls to a low level in a still shorter period of time than the third light-emission-period control signal H3 that has previously been output. In this case, suppose that L1 indicates the integrated brightness of the organic EL elements OLED of the pixels 20 connected to the first scan line Y1. Similarly, suppose that L2 indicates the integrated brightness of the organic EL elements OLED of the pixels 20 connected to the second scan line Y2, L3 indicates the integrated brightness of the organic EL elements OLED of the pixels 20 connected to the third scan line Y3, and L4 indicates the integrated brightness of the organic EL elements OLED of the pixels 20 connected to the fourth scan line Y4. Then, the integrated brightness of the organic EL elements OLED decreases in the order of L1→L2→L3→L4.

With such an arrangement, in accordance with the brightness of the organic EL elements OLED of all the pixels 20, the integrated brightness of the organic EL elements OLED can be controlled for each selected scan line.

Electro-optical elements or electroluminescent elements recited in the claims correspond to, for example, the organic EL elements OLED in this embodiment. Active elements recited in the claims correspond to, for example, the drive transistors Qd in this embodiment. Switching elements recited in the claims correspond to, for example, the light-emission-period control transistors Qc in this embodiment. Signal lines recited in the claims correspond to, for example, the data lines X1, X2, . . . , and Xm in this embodiment.

An electro-optical device recited in the claims corresponds to, for example, the organic EL display 10 in this embodiment. A voltage amplifier circuit recited in the claims corresponds to, for example, the amplifier 31 in this embodiment.

The above described embodiment can provide the following features.

(1) In the above embodiment, the display includes the brightness detection circuit 15 for sampling the power-supply current Io every time one scan line is selected and converting the power-supply current Io into the digital voltage signal DS having a digital value corresponding to the power-supply current Io. The light-emission-period control circuit 16 generates the light-emission-period control signals H1 to Hn in accordance with the light-emission-period adjusting signal F corresponding to the digital voltage signal DS and outputs the light-emission-period control signals H1 to Hn to the corresponding control-signal supply lines G1 to Gn. Further, the light-emission-period control transistors Qc of the pixels 20 connected to the corresponding control-signal supply lines G1 to Gn are on/off controlled. As a result, it is possible to control the light-emission period of the organic EL elements OLED of the pixels 20.

Thus, the voltage-current characteristics of the drive transistors Qd do not vary. As a result, it is possible to accurately control the integrated brightness of the organic EL elements OLED in accordance with the signal levels of the data signals VD1 to VDm.

(2) In the above embodiment, the brightness detection circuit 15 samples the power-supply current Io every time one scan line is selected and generates the digital voltage signal DS, so that the integrated brightness can be controlled immediately in response to a variation in the power-supply current Io.

(3) In the above embodiment, the amplifier 31 and the A/D converter circuit 32 constitute the brightness detection circuit 15. Thus, a current input to the amplifier 31 can be substantially ignored, so that the power consumption can be reduced correspondingly.

(4) In the above embodiment, when the organic EL display 10 is configured with a full-color displayable display having organic EL elements that emit red light, having organic EL elements that emit green light, and having organic EL elements that emit blue light along the direction of the scan lines Y1 to Yn (the control-signal lines G1 to Gn), the light-emission brightness of the organic EL elements that emit one of red light, green light, and blue light and that are connected to each corresponding control-signal supply line is simultaneously controlled. Thus, compared to a case in which the light emission brightness is controlled independently for each color, the above embodiment allows the light-emission period of the electro-optical elements to be controlled without a variation in the balance (color balance) of red, green, and blue of the electro-optical elements.

Second Embodiment

Figure 5:
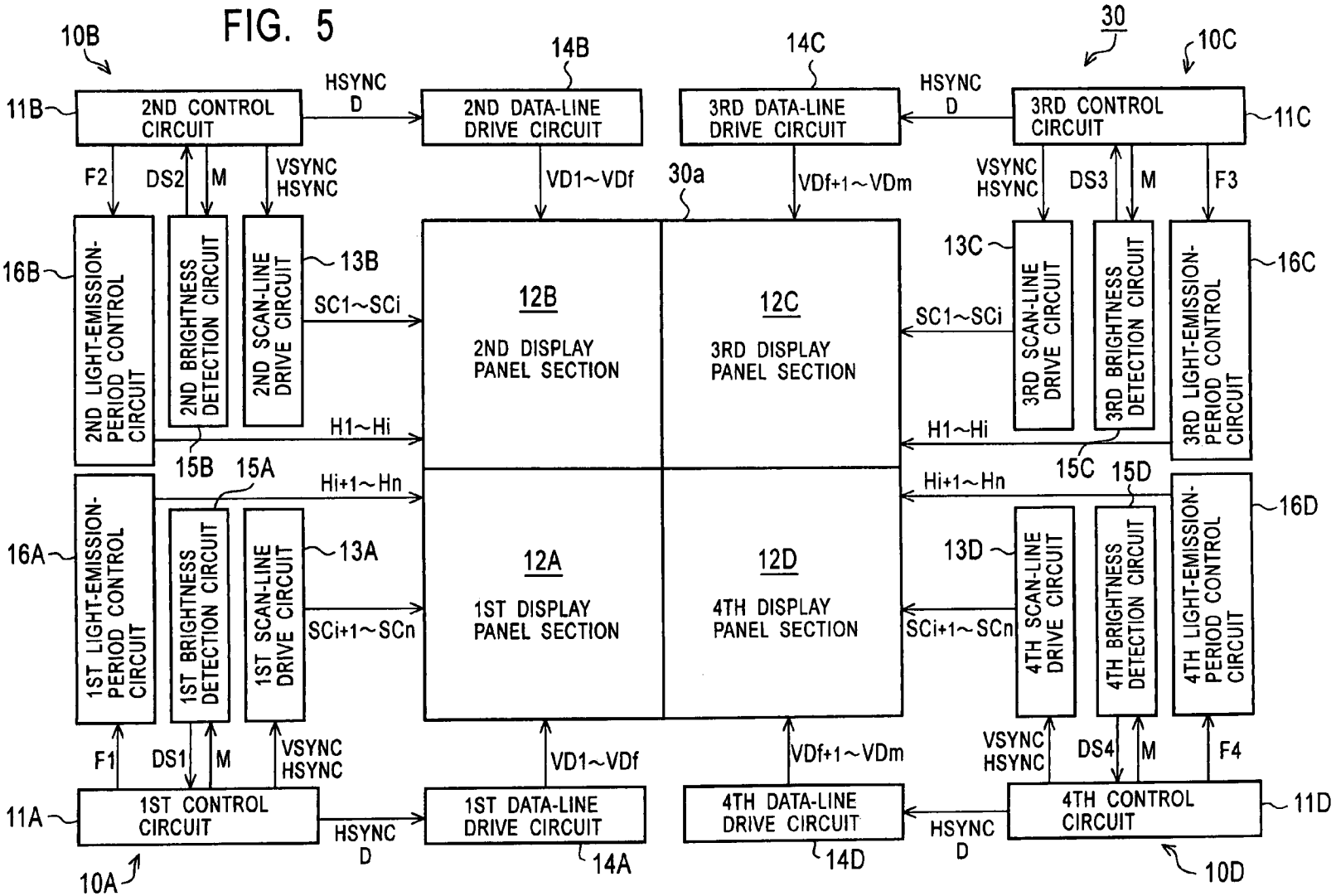
FIG. 5 is a block diagram illustrating the electrical configuration of an organic EL display according to a second embodiment.

A second embodiment according to the present invention will now be described with reference to FIG. 5. In an organic EL display of a second embodiment, four display panel sections 12 in the organic EL display 10 of the first embodiment are laminated in the lower left, upper left, upper right, and lower right directions to configure an organic EL display having one large display panel section.

That is, a display panel section 30*a* of an organic EL display 30 of this embodiment is divided into four areas, i.e., lower left, upper left, upper right, and lower right areas. The lower-left display area in FIG. 5 is referred to as a first display panel section 12A, the upper-left display area is referred to as a second display panel section 12B, the upper right display area is referred to as a third display panel section 12C, and the lower right display area is referred to as a fourth display panel section 12D.

The display panel sections 12A to 12D are provided with corresponding first to fourth control circuits 11A to 11D, first to fourth scan-line drive circuits 13A to 13D, first to fourth data-line drive circuits 14A to 14D, first to fourth brightness detection circuits 15A to 15D, and first to fourth light-emission-period control circuits 16A to 16D.

Of the first to nth scan lines Y1 to Yn, the second scan-line drive circuits 13B and the third scan-line drive circuit 13C line-sequentially select the first scan line Y1 to the ith scan line Yi which are arranged at the upper half of the display panel section 30*a*. The first scan-line drive circuit 13A and the fourth scan-line drive circuit 14D line-sequentially select the (i+1)th scan line Yi+1 to the nth scan line Yn which are arranged at the lower half of the display panel section 30*a*.

Of the first to mth data lines X1 to Xm, the first data-line drive circuit 14A and the second data-line drive circuit 14B output data signals VD1 to VDf for images displayed at the left half of the display panel section 30*a*. The third data-line drive circuit 14C and the fourth data-line drive circuit 14D output data signals VDf+1 to VDm for images displayed at the right half of the display panel section 30*a*.

In the organic EL display 30 having such a configuration, the first brightness detection circuit 15A measures power-supply current Io that flows through the measuring resistance element in accordance with a power-supply voltage supplied to the first display panel section 12A via power-supply lines and a measuring resistance element which are not shown. The second brightness detection circuit 15B also measures power-supply current Io in the second display panel section 12B. Similarly, the third brightness detection circuit 15C measures power-supply current Io in the third display panel section 12C and the fourth brightness detection circuit 15D measures power-supply current Io in the fourth display panel section 12D. The brightness detection circuits 15A to 15D output digital voltage signals DS1 to DS4, corresponding to the current levels of power-supply currents Io of the respective divided display panel sections, to the respective first to fourth control circuits 11A to 11D.

In accordance with the digital voltage signal DS1, the first control circuit 11A generates a first light-emission period adjusting signal F1 for determining the light-emission period of the organic EL elements arranged in the first display panel sections 12A and outputs the first light-emission period adjusting signal F1 to the first light-emission-period control circuit 16A. As a result, as in the first embodiment, the organic EL elements of the first display panel section 12A is accurately controlled in accordance with the signal levels of the data signals VD1 to VDf without a variation in the voltage-current characteristics of the corresponding drive transistors.

Similarly, in accordance with the digital voltage signal DS2, the second control circuit 11B generates a second light-emission period adjusting signal F2 for determining the light-emission period of the organic EL elements arranged in the second display panel sections 12B and outputs the second light-emission period adjusting signal F2 to the second light-emission-period control circuit 16B. Similarly, in accordance with the digital voltage signal DS3, the third control circuit 11C generates a third light-emission period adjusting signal F3 for determining the light-emission period of the organic EL elements arranged in the third display panel sections 12C and outputs the third-light-emission period adjusting signal F3 to the third light-emission-period control circuit 16C. Similarly, in accordance with the digital voltage signal DS4, the fourth control circuit 11D generates a fourth light-emission period adjusting signal F4 for determining the light-emission period of the organic EL elements arranged in the fourth display panel sections 12D and outputs the fourth light-emission period adjusting signal F4 to the fourth light-emission-period control circuit 16D.

As a result, as in the organic EL elements of the first display panel section 12A, the organic EL elements of the second to fourth display panel sections 12B to 12D are accurately controlled in accordance with the signal levels of the data signals VD1 to VDm without a variation in the voltage-current characteristics of the corresponding drive transistors.

Third Embodiment

An electronic apparatus incorporating the organic EL display 10 or 30, which serves as an electro-optical device and which has been described in the first and second embodiments, will now be described with reference to FIG. 6. The organic EL displays 10 and 30 are applicable to various electronic apparatuses, such as mobile personal computers, portable telephones, digital cameras, and televisions for digital broadcast.

Figure 6:
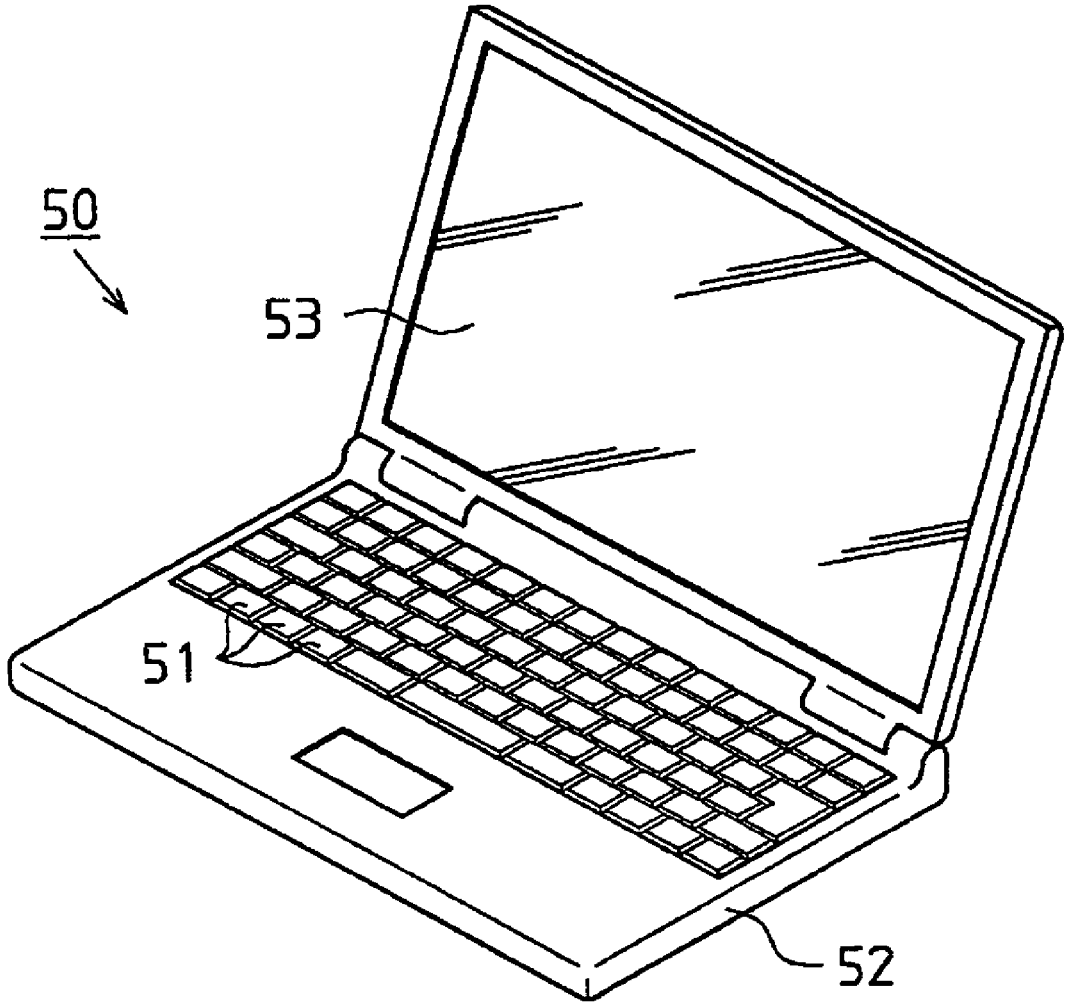
FIG. 6 is a perspective view illustrating the configuration of a mobile personal computer to describe a third embodiment.

FIG. 6 is a perspective view of the configuration of a mobile personal computer. Referring to FIG. 6, a personal computer 50 includes a main unit 52, which has a keyboard 51, and a display unit 53, which incorporates the organic EL display 10 or 30. In this case, the display unit 53, which incorporates the organic EL display 10 or 30, offers the same advantages as the first embodiment described above. Consequently, it is possible to provide a mobile personal computer 50 having the organic EL display 10 or 30 that is superior in display quality.

Embodiments of the present invention are not limited to the above-described embodiments, and thus may be practiced as follows.

Although the measuring resistance element Rv in the first and second embodiments is provided at a position other than the display panel section 12, the present invention is not particularly limited thereto. Thus, the measuring resistance element Rv may be provided on the display panel section 12. Such an arrangement can provide the same advantages as the above-described embodiments.

Although the organic EL display 10 in the first and second embodiments includes the pixels 20 having one-color organic EL elements OLED, the present invention is not limited thereto. For example, the present invention may be applied to an EL display that has pixels 20 for the organic EL elements OLED for three colors, i.e., red, green, and blue. In such a case, the brightness detection circuit 15 is provided for each color to generate a digital voltage signal DS corresponding to power-supply current Io for each color. Further, in accordance with the generated digital voltage signal DS for each color, the light-emission-period control transistors Qc of pixels for each color are on/off controlled. Such an arrangement can accurately control the brightness of a full-color-displayable organic EL display.

The brightness detection circuit 15 also converts a potential corresponding to the power-supply current Io for each color into a digital signal to produce the digital voltage signal DS, and in accordance with the digital voltage signal DS, the light-emission-period control transistors Qc of pixels for each color are on/off controlled. This makes it possible to control the brightness of the organic EL elements OLED without a variation in the color balance of the pixels. As a result, it is possible to provide a full-color displayable organic EL display that is superior in display quality.

In addition, the brightness detection circuit 15 converts the power-supply voltage Io for each of the red, green, and blue into the digital voltage signal DS for each color and samples the digital voltage signal DS, and the control circuit 11 converts the digital voltage signal DS for each color into a digital voltage signal corresponding to power-supply current for a case in which white is displayed. In accordance with the digital voltage signal for a case in which white is displayed, the control circuit 11 may generate a light-emission-period adjusting signal F for determining the light-emission period of the organic EL elements and output the generate light-emission-period adjusting signal F to the light-emission-period control circuit 16.

Such an arrangement can control the light emission period of the organic EL elements without a variation in the balance (color balance) of red, green, and blue.

In the first and second embodiments, every time one scan line is selected, the brightness detection circuit 15 digitally converts the power-supply current Io to generate the digital voltage signal DS. Alternatively, every time two or more of the scan lines are selected, the brightness detection circuit 15 may digitally convert the power-supply current Io to generate the digital voltage signal DS. Such an arrangement can provide the same advantages as the above-described embodiments.

Although the brightness detection circuit 15 is provided at the anode sides of the organic EL elements OLED in the first and second embodiments, the present invention is not limited thereto and thus the brightness detection circuit 15 may be provided at the cathode sides of the organic EL elements OLED. Such an arrangement can increase the freedom of layout of the organic EL display 10.

Although the brightness detection circuit 15 employs a voltage amplifying scheme for converting the power-supply current Io into a voltage and amplifying the voltage in the first and second embodiments, the present invention is not limited thereto. For example, another scheme, such as a transimpedance scheme, may be used to convert the power-supply current Io into a voltage and to amplify the voltage. Such an arrangement can provide the same advantages as the above-described embodiments.

In the first and second embodiments, the control circuit 11 samples the power-supply current Io for each scan line. Alternatively, the control circuit 11 may be such that, when the digital value of the digital voltage signal DS is greater than or equal to a predetermined value or less than or equal to a predetermined value, the control circuit 11 outputs the light-emission-period adjusting signal F in accordance with the digital value. Such an arrangement can reduce the load of the control circuit 11.

Although the brightness is constantly controlled in the first and second embodiments, the arrangement may be such that the brightness controlling function is disabled by a user-defined mode.

Although the organic EL display 10 includes the organic EL elements OLED that emit light once every time one scan line is selected in the first and second embodiments, the present invention is not limited thereto. For example, the organic EL display 10 may include organic EL elements OLED that emit light multiple types every time one scan line is selected.

Although the present invention is applied to the organic EL display in which the pixels 20 have the organic EL elements OLED in the illustrated embodiments, the present invention may also be applied to an electro-optical device that drives electro-optical elements, such as LEDs or FEDs, other than the organic EL elements OLED. That is, the present invention may be applied to an electro-optical device having any electro-optical elements whose brightness varies in accordance with a power-supply voltage.

Although the data signals VD1 to VDm in the organic EL display 10 are analog voltage signals in the illustrated embodiment, the present invention may also be applied to an organic EL display whose drive current Iel is controlled in accordance with data signals that are analog current signals. Similarly, the present invention may be applied to a pulse-wide-modulation (PWM) system organic EL display 10.

Figure 7:
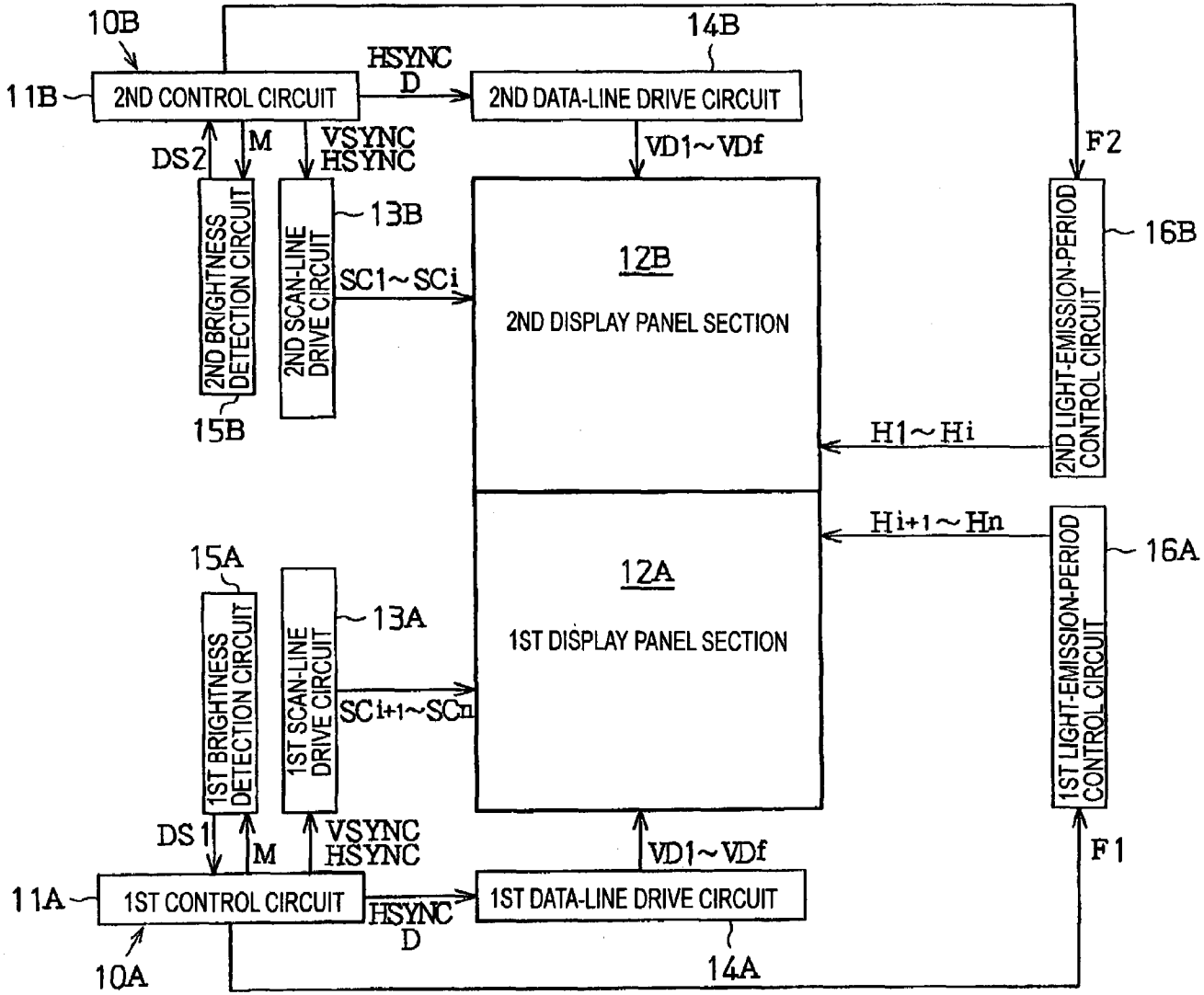
FIG. 7 is diagram for describing another example of the organic EL display.
Figure 8:
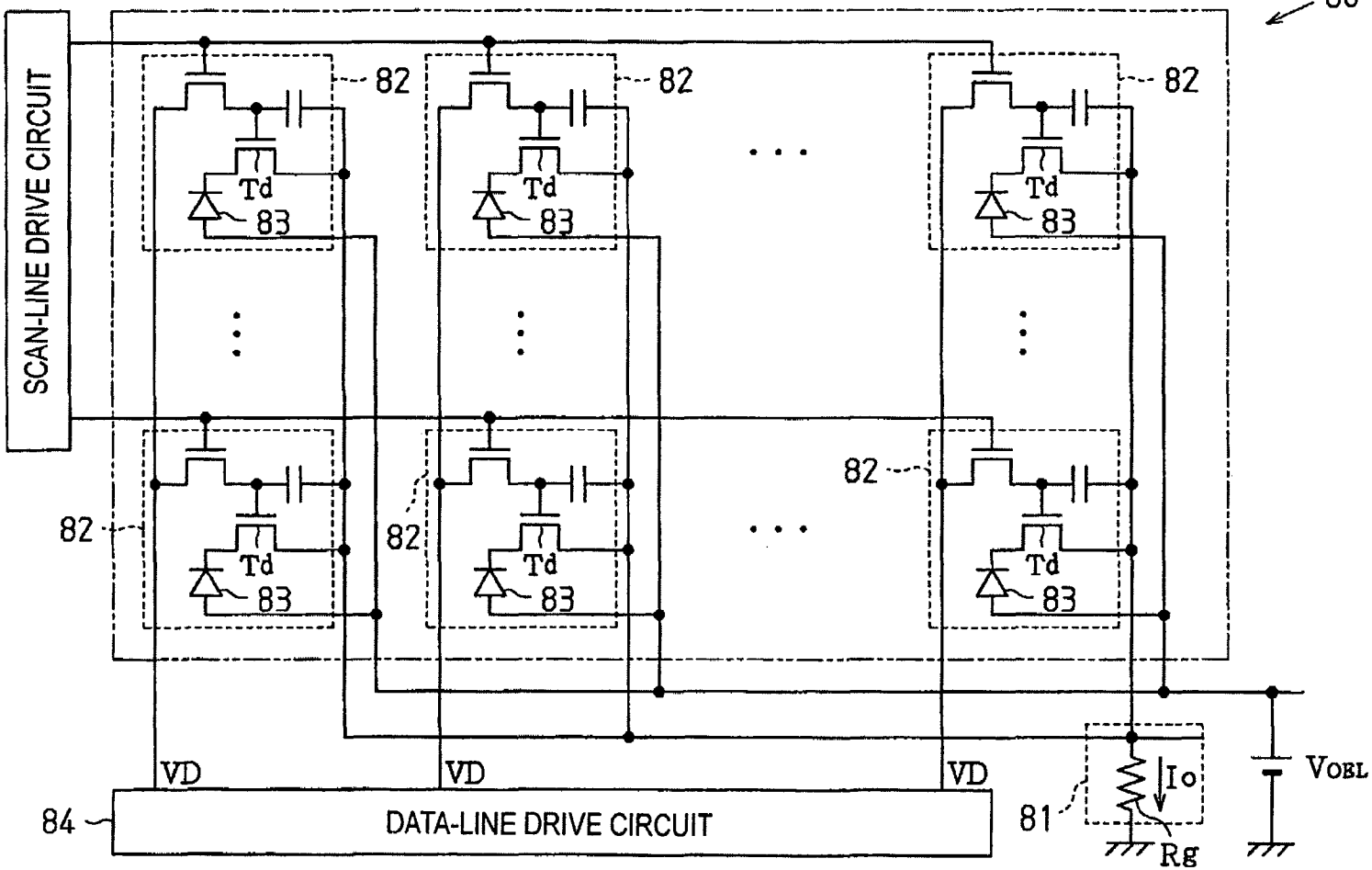
FIG. 8 Related Art
FIG. 8 is a circuit block diagram of a known organic EL display.

Although the present invention is applied to the organic EL display in which four display panel sections 12 are laminated in the lower left, upper left, upper right, and lower right directions to configure one large display panel section in the second embodiment, the present invention is not limited thereto. For example, as shown in FIG. 7, the present invention may be applied to an organic EL display in which display sections 12 are laminated together in the upper and lower directions to configure one large display panel section. Such an arrangement provides the same advantages as the above-described embodiments.

What is claimed is:

1. An electro-optical device comprising:

a plurality of scan lines, a plurality of signal lines, pixels arranged at positions corresponding to respective intersections of the scan lines and the signal lines, a power-supply voltage is supplied to the pixels, active elements included in the pixels, which are driven in accordance with a signal level of an analog signal supplied to the signal lines, electro-optical elements, which emit light in accordance with a current level of drive current controlled by the active elements, a plurality of power-supply lines, each power supply line of the plurality of power-supply lines being in parallel with a corresponding scan line and connected to individual pixels in one corresponding row, a brightness detection circuit for converting current corresponding to the power-supply voltage into a digital value every time one of the scan lines is selected, a control circuit that receives the digital value and outputs a light-emission-period adjusting signal in accordance with the digital value, a light-emission-period control circuit that receives the light-emission-period adjusting signal and outputs a control signal in accordance with the light-emission-period adjusting signal that is based on the digital value, a plurality of control signal supply lines that supply the control signal to corresponding pixels and the pixels comprising switching elements that are controlled by the control signal, and a length of a light emitting period of the electro-optical elements being controlled in accordance with the control signal.

2. The electro-optical device according to claim 1, wherein the switching elements electrically connect or disconnect the active elements and the electro-optical elements, and the switching elements perform the electrical connection or disconnection in accordance with the control signal.

3. The electro-optical device according to claim 1, wherein the brightness detection circuit comprises an analog-to-digital converter circuit and a voltage amplifier circuit.

4. The electro-optical device according to claim 1, wherein, when the digital value is greater than or equal to a predetermined value or less than or equal to a predetermined value, the light-emission-period control circuit controls the peak brightness of the electro-optical elements in accordance with the control signal.

5. The electro-optical device according to claim 1, wherein the brightness detection circuit is provided at anode sides or cathode sides of the electro-optical elements.

6. The electro-optical device according to claim 1, wherein the electro-optical elements comprise electro-optical elements that emit red light, electro-optical elements that emit green light, and electro-optical elements that emit blue light, and the light-emission-period control circuit controls the light-emission period of the electro-optical elements that emit red light, the light-emission period of the electro-optical elements that emit green light, and the light-emission period of the electro-optical elements that emit blue light at the same rate to control the peak brightness.

7. The electro-optical device according to claim 1, wherein the electro-optical elements comprise electro-optical elements that emit red light, electro-optical elements that emit green light, and electro-optical elements that emit blue light;

the brightness detection circuit converts current corresponding to the power supply voltage for the electro-optical elements for each color into a digital value and samples the digital value; and the light-emission-period control circuit determines brightness for a case in which white is displayed, based on the converted current corresponding to the power-supply voltage for the electro-optical elements for each color and controls the light-emission period of the electro-optical elements in accordance with a result of the determination to thereby control the peak brightness.

8. The electro-optical device according to claim 1, wherein the display panel section where the pixels are arranged is divided into a plurality of sections;

the brightness detection circuit converts current corresponding to the power-supply voltage supplied to the electro-optical elements of each divided display panel section into a digital value and samples the digital value; and the light-emission-period control circuit controls the peak brightness of the electro-optical elements of each divided display panel section.

9. The electro-optical device according to claim 1, wherein the electro-optical elements comprise electroluminescent elements having light-emitting layers made of organic material.

10. An electronic apparatus comprising the electro-optical device according to claim 1.

11. An electro-optical device comprising:

a plurality of scan lines, a plurality of signal lines, and pixels arranged at positions corresponding to respective intersections of the scan lines and the signal lines, wherein a power-supply voltage is supplied to the pixels, active elements, which are driven in accordance with a signal level of an analog signal supplied to the signal lines, electro-optical elements, which emit light in accordance with a current level of drive current controlled by the active elements, a brightness detection circuit for converting current corresponding to the power-supply voltage into a digital value every time one of the scan lines is selected, a control circuit that receives the digital value and outputs a light-emission-period adjusting signal in accordance with the digital value, a light-emission-period control circuit that receives the light-emission-period adjusting signal and supplies a control signal in accordance with the light-emission-period adjusting signal that is based on the digital value to corresponding pixels for controlling swicthing elements included in the pixels, and a length of a light emitting period of the electro-optical elements being controlled in accordance with the control signal.

12. A driving method for an electro-optical device that comprises a plurality of scan lines, a plurality of signal lines, a plurality of power-supply lines extending parallel to the scan lines, a plurality of control signal supply lines and pixels arranged at positions corresponding to respective intersections of the scan lines and the signal lines, wherein the pixels include active elements, electro-optical elements and switching elements, the active elements are driven in accordance with a voltage level of a power-supply voltage, and the electro-optical elements emit light in accordance with a current level of drive current controlled by the active elements, the method comprising the steps of:

converting current corresponding to the power-supply voltage into a digital value every time one of the scan lines is selected;

receiving the digital value and outputing a light-emission-period adjusting signal in accordance with the digital value;

receiving the light-emission-period adjusting signal and supplying a control signal in accordance with the light-emission-period adjusting signal that is based on the digital value with the plurality of control signal supply lines to the switching elements of corresponding pixels; and controlling the switching elements to control a length of a light emitting period of the electro-optical elements in accordance with the control signal.

13. The driving method according to claim 12, wherein, in the step of converting current corresponding to the power-supply voltage into a digital value and sampling the digital value, the sampling is performed every time one of the scan lines is selected.

14. The driving method according to claim 12, wherein, in the step of converting current corresponding to the power-supply voltage into a digital value and sampling the digital value, the sampling is performed after two or more of the scan lines are selected.

15. A driving method for an electro-optical device that comprises a plurality of scan lines, a plurality of signal lines, a plurality of power-supply lines extending parallel to the scan lines, and pixels arranged at positions corresponding to respective intersections of the scan lines and the signal lines, wherein the pixels include active elements, electro-optical elements and switching elements, the active elements are driven in accordance with a voltage level of a power-supply voltage, and the electro-optical elements emit light in accordance with a current level of drive current controlled by the active elements, the method comprising the steps of:

converting current corresponding to the power-supply voltage into a digital value every time one of the scan lines is selected;

receiving the digital value and outputing a light-emission-period adjusting signal in accordance with the digital value;

receiving the light-emission-period adjusting signal and supplying a control signal in accordance with the light-emission-period adjusting signal that is based on the digital value to the switching elements of corresponding pixels; and controlling the switching elements to control a length of a light emitting period of the electro-optical elements in accordance with the control signal to adjust the peak brightness.

* * * * *